US010392885B2

(12) United States Patent
Stjern et al.

(10) Patent No.: US 10,392,885 B2
(45) Date of Patent: Aug. 27, 2019

(54) METHOD AND APPARATUS FOR PLUGGING A WELL

(71) Applicant: STATOIL PETROLEUM AS, Stavanger (NO)

(72) Inventors: Gisle Stjern, Trondheim (NO); Gjermund Grimsbo, Trondheim (NO); Halvor Kjørholt, Trondheim (NO); Pål Viggo Hemmingsen, Trondheim (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 15/821,352

(22) Filed: Nov. 22, 2017

(65) Prior Publication Data

US 2018/0142527 A1 May 24, 2018

(30) Foreign Application Priority Data

Nov. 24, 2016 (GB) ..... 1619910.1

(51) Int. Cl.

| | |
|---|---|
| ***E21B 23/04*** | (2006.01) |
| ***E21B 33/12*** | (2006.01) |
| ***E21B 33/14*** | (2006.01) |
| ***E21B 33/134*** | (2006.01) |
| ***E21B 43/116*** | (2006.01) |

(52) U.S. Cl.

CPC ..... *E21B 23/04* (2013.01); *E21B 33/1204* (2013.01); *E21B 33/134* (2013.01); *E21B 33/14* (2013.01); *E21B 43/116* (2013.01)

(58) Field of Classification Search

CPC ..... E21B 23/04; E21B 33/1204; E21B 33/14

USPC ..... 166/285

See application file for complete search history.

(56) References Cited

U.S. PATENT DOCUMENTS

| | | | |
|---|---|---|---|
| 1,734,670 | A | 11/1929 | Greene |
| 2,591,807 | A | 4/1952 | Greene |
| 2,718,264 | A | 9/1955 | Allen et al. |

(Continued)

FOREIGN PATENT DOCUMENTS

| | | | |
|---|---|---|---|
| WO | WO 2012/096580 | A1 | 7/2012 |
| WO | WO 2014/117846 | A1 | 8/2014 |

(Continued)

OTHER PUBLICATIONS

United Kingdom Combined Search and Examination Report, dated Feb. 27, 2017, for United Kingdom Application No. GB1619910.1.

*Primary Examiner* — Silvana C Runyan

(74) *Attorney, Agent, or Firm* — Birch, Stewart, Kolasch & Birch, LLP

(57) ABSTRACT

A method of plugging a well extending into a formation to facilitate temporary or permanent abandonment of the well. The method comprises conveying in one trip, a plug assembly and one or more explosive charges through the well together with a structure for providing wet sealant. The plug assembly comprises a foundation plug for supporting the wet sealant. The plug assembly is set beneath a plug formation location, prior to providing the wet sealant. The method also comprises providing the wet sealant to the plug formation location via the structure, so as to submerge the one or more explosive charges in the wet sealant, and then detonating the one or more explosive charges in the wet sealant at the plug formation location to cut through a tubular or tubulars of the well and into the formation.

11 Claims, 6 Drawing Sheets

(56) References Cited

U.S. PATENT DOCUMENTS

| | | | | |
|---|---|---|---|---|
| 2,856,002 | A * | 10/1958 | True | E21B 33/127 166/114 |
| 2,918,124 | A | 12/1959 | Spearow | |
| 3,053,182 | A | 9/1962 | Christopher | |
| 5,667,010 | A | 9/1997 | Boyd et al. | |
| 5,704,426 | A * | 1/1998 | Rytlewski | E21B 23/00 166/297 |
| 6,561,269 | B1 * | 5/2003 | Brown | C04B 28/34 166/101 |
| 2003/0150614 | A1 | 8/2003 | Brown et al. | |
| 2005/0028980 | A1 | 2/2005 | Page et al. | |
| 2009/0260817 | A1 | 10/2009 | Gambier et al. | |
| 2011/0042087 | A1 | 2/2011 | Challacombe | |
| 2015/0361759 | A1 * | 12/2015 | Kjorholt | E21B 33/13 166/286 |
| 2016/0215586 | A1 * | 7/2016 | Hemmingsen | E21B 33/134 |

FOREIGN PATENT DOCUMENTS

| | | | |
|---|---|---|---|
| WO | WO 2014/148913 | A1 | 9/2014 |
| WO | WO 2015/044151 | A2 | 4/2015 |

* cited by examiner

METHOD AND APPARATUS FOR PLUGGING A WELL

TECHNICAL FIELD

The present invention relates to a method and apparatus for plugging a well extending into a hydrocarbon bearing formation.

BACKGROUND

Oil and gas wells have in general three different purposes, as producers of hydrocarbons, injectors of water or gas for reservoir pressure support or for depositing purposes, or as exploration wells. At some point it is likely to be necessary to satisfactorily plug and seal these wells, e.g. after the wells have reached their end-of life and it is not economically feasible to keep the wells in service (so-called "plug and abandon"), or for some temporary purpose (e.g. "slot recovery"). Plugging of wells is performed in connection with permanent abandonment of wells due to decommissioning of fields or in connection with permanent abandonment of a section of well to construct a new wellbore (known as side tracking or slot recovery) with a new geological well target.

A well is constructed by drilling a hole into the reservoir using a drilling rig and then inserting sections of steel pipe, casing or liner into the hole to impart structural integrity to the wellbore. Cement is injected between the outside of the casing or liner and the formation and then tubing is inserted into the casing to connect the wellbore to the surface. For ease of reference, all of these entities inserted into the well are referred to here as "tubulars". When the well is to be abandoned, either temporarily or permanently, a plug must be established across the full cross-section of the well. This is generally achieved by removal of the tubulars from the well bore by pulling the tubulars to the surface or by section milling. Plugs are then established across the full cross-section of the well, in order to isolate the reservoir(s) and prevent flow of formation fluids between reservoirs or to the surface. The plug location is typically above the hydrocarbon reservoir(s) to further prevent flow of formation fluids.

It is sometimes necessary to remove the tubulars from the wellbore because in general it is not possible to be certain that the quality of the sealant (e.g. cement) behind the tubular(s), i.e. between the tubular(s) and the formation, is adequate to form part of the plug—thereby necessitating the installation and verification of a completely new cross-sectional plug.

To save having to remove an entire length of tubular from a well, a tool may be inserted into the well to cut the tubulars at a point beneath that at which the plug is to be formed, with only the upper detached parts of the tubulars being removed from the well. It is also possible to use a milling tool to mill away a part of the tubulars at the location where the plug is to be formed or to use explosive charges or perforation guns to remove parts of the tubular at said location. Following removal of the tubulars, the casing and surrounding formation are perforated (if not already done) using explosive charges or perforation guns in order to establish fluid flow paths between the centre of the well and the formation. Subsequently, the location can be filled with a sealant to form a plug, with sealant flowing onto the formation via the fluid flow paths. It is important that the sealant fills the whole plug formation location, without leaving voids, to achieve good plug integrity.

Currently, placement of plugs is typically performed by pumping the wet cement from the well topside through a drill pipe or coil tubing. Due to uncertainty of placement and contamination with other fluids, a rather long length is required per plug, e.g. 50 m, to ensure the required plug integrity. After the cement is placed and has cured, the cement plug is typically subjected to a large downwards force, for example 10 tonnes, and pressure tested to ensure that the cement is set properly. This constitutes integrity testing of the cement plug, to ensure it meets specified standards for permanent or temporary abandonment of a well, for example.

An improperly plugged well is a serious liability so it is important to ensure that the well is adequately plugged and sealed. However, it can be difficult to achieve adequate penetration of sealant into the plug formation location. For example, debris from the removed tubulars, cement, etc., can cause blockages that prevent the sealant from filling the full cross-section of the well.

WO 2015/044151 relates to a method of sealing a well in which a wireline is employed to locate a tubular, typically referred to as a "stinger", in a location within a wellbore where one or more openings have been created in a tubing installed in the wellbore to expose the formation. A sealant, e.g. cement, is injected through the stinger to form a plug at said location.

WO 2014/117846 relates to a method of plugging a well in which one or more explosive charges are detonated within a tubular or tubulars extending through the well in order to remove, fragment and or cut one or more sections of the tubulars around the entire circumference of the well to expose the surrounding formation or cement. The well is subsequently filled in the exposed region with a sealing material so as to form one or more plugs within the well.

U.S. Pat. No. 2,918,124 A, US 2009/260817 A1, US 2003/150614 A1, U.S. Pat. Nos. 5,667,010 A, 3,053,182 A, WO 2012/096580 A1 and US 2005/028980 A1 describe methods relating to well plug and abandonment.

SUMMARY

According to a first aspect of the present invention there is provided a method of plugging a well extending into a formation to facilitate temporary or permanent abandonment of the well. The method comprises conveying in one trip, a plug assembly and one or more explosive charges through the well together with a structure for providing wet sealant. The plug assembly comprises a foundation plug for supporting the wet sealant. The plug assembly is set beneath a plug formation location, prior to providing the wet sealant. The method also comprises providing the wet sealant to the plug formation location via the structure, so as to submerge the one or more explosive charges in the wet sealant, and then detonating the one or more explosive charges in the wet sealant at the plug formation location to cut through a tubular or tubulars of the well and into the formation.

The invention may thus facilitate improved plug quality, by improving sealant penetration into the various voids. In particular, as the sealant flows upon and immediately following the detonation, it is unlikely that flow paths that are opened by the detonation will be blocked again before the sealant is able to flow through these paths. In addition, the force of the blasts themselves may aid flow of the sealant. Certain embodiments of the present invention may reduce the number of steps required to plug a well, e.g. the number of trips in and out of the well, which can lead to cost and/or time savings.

The method may comprise conveying through the well to the plug formation location, a structure for providing the wet sealant, and providing the wet sealant to the plug formation location via said structure. The one or more explosive charges are then conveyed to the plug formation location, thereby submerging the one or more explosive charges in the wet sealant prior to detonating.

The method may further comprise conveying one or more of the components through the well, to the plug formation location, using one of a; drillstring, coil tubing, and wireline.

The above mentioned tubular or tubulars may include at least a casing and a surrounding cement layer between the casing and the formation, and optionally a production liner.

The method may comprise detonating a plurality of explosive charges, wherein these are detonated sequentially, optionally with a lowermost charge being detonated first.

Additional sealant can be provided to the plug formation location after detonating the one or more explosive charges. Also, the well can be pressurised above the plug formation location after detonating the one or more explosive charges whilst the sealant remains wet.

The plug formation location may be above a production packer, and the method may comprise pulling out tubing above the production packer, or partially lifting tubing above the production packer, prior to conveying the one or more explosive charges and providing the wet sealant. Alternatively, the tubing may be left in the well above the production packer, throughout the plugging operation. In another embodiment of the present invention, the plug formation location may be below a production packer.

According to a second aspect of the present invention there is provided an apparatus for use in plugging a well extending into a formation to facilitate temporary or permanent abandonment of the well. The apparatus comprises a cement stinger having attached thereto one or more explosive charges. The apparatus may comprise a coupling for attaching the stinger to one of a drillstring, coil tubing, and wireline.

DETAILED DESCRIPTION

Figure 1:
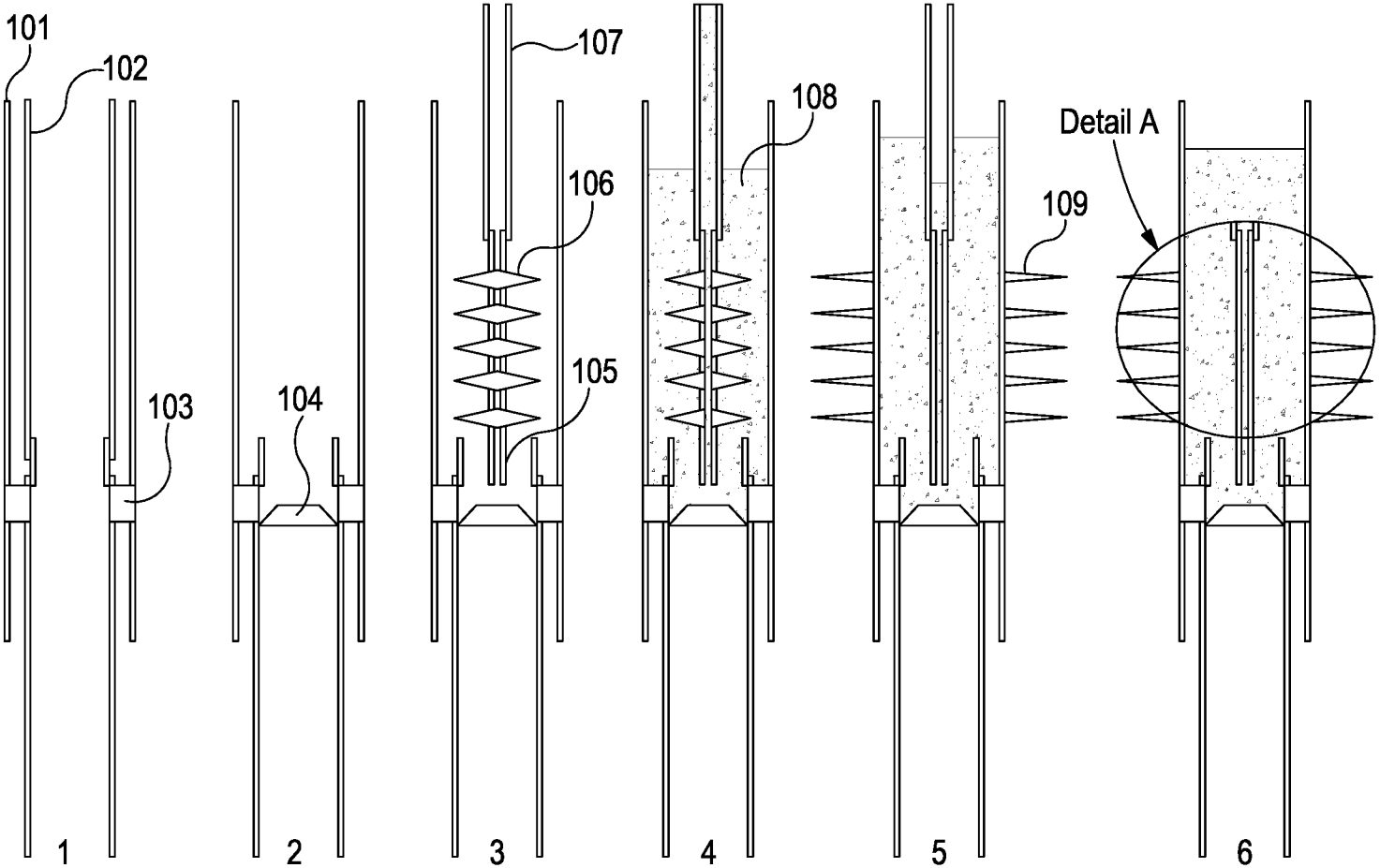
FIG. 1 illustrates a procedure for forming a plug in a well.

In the context of the need to plug wells for either temporary or permanent abandonment, it is proposed here to use explosive charges to cut through one or more sections of tubulars (e.g. casing and liner) within the well and into the surrounding formation, wherein the charges are submerged in a wet sealant when detonated. This is desirable as it facilitates improved penetration of the sealant into the cuts and the space between the tubulars and the formation surrounding the well. Furthermore, by detonating the charges whilst submerged by the sealant, a reduced number of steps of the plugging operation can be achieved.

The well comprises well casing and tubings (e.g. liner), collectively referred to as tubulars. The tubing above the plug formation location is pulled out of the well or partially lifted to expose a section of the inner wall of the casing. A foundation plug (e.g. a bridge plug) is set at the lower end of the plug formation location. The foundation plug may be a part of a plug assembly, which comprises further plugging and plug verification equipment (e.g. temperature and pressure sensors). A carrier string with explosive charges is conveyed down the well by a drillstring, or coil tubing, or wireline. The well is filled in the region of the plug formation location with a sealant (e.g. wet cement or one or two component epoxy), thereby submerging the explosive charges in wet sealant. If wireline is used, the sealant is carried down in a container above or below the explosive charges and brought into the plug formation location before detonation. If drillstring or coil tubing is used, the sealant is circulated down the well. The charges may be attached to a cement stinger, which in this context is a tubular at the lower part of the workstring (tubular) through which the wet sealant is extruded. An amount of sealant that fills the well to a level significantly above the top of the explosive charges can be used if necessary to ensure enough sealant material for the plug. The charges are detonated in the wet sealant to cut through the tubulars and into the surrounding formation. The detonation may also cut through any control lines (hydraulic and electric) that are clamped (outside) to any of the tubulars. The charges can be directional to make radial cuts that are separated along the longitudinal axis. For better sealant penetration into the cuts, the charges are detonated sequentially, preferentially, but not necessarily starting with the lowermost charge (i.e. the charge closest to the foundation plug). Vibrations and pressure from subsequent blasts further promotes flow of the wet sealant into the lower cuts. After detonation, additional sealant can be added if necessary. The well can be pressurised above the plug formation location if required to squeeze the sealant into the cuts and the space between the casing and the surrounding formation. The drillstring, or coil tubing, or wireline is disconnected from the charge carrier string and pulled out. Alternatively, it is not disconnected and the charge carrier string is also pulled out. Then the wet sealant is allowed to set/cure to form the plug.

FIG. 1 illustrates a sequence of steps, 1 to 6 forming part of a procedure for plugging a well in accordance with an embodiment of the invention. Step 1 shows a well, with well casing 101, tubing 102 and a production packer 103. In step 2, the whole or part of the tubing 102 has been pulled out to expose the inner wall of the casing 101 in the region of the plug formation location. A foundation plug 104 (e.g. a bridge plug) is set below the exposed region, to form the base of the plug. A carrier string (stinger) 105 with explosive charges 106 is lowered to the plug area using a drillstring 107 at step 3. In step 4 a sealant 108 is circulated down to the plug area through the drillstring 107, so that the area above the foundation plug 104 fills up with sealant 108 and submerges the explosive charges 106 in the sealant 108. The charges 106 are detonated in the wet sealant 108 in step 5, creating radial cuts 109 through the casing 101 and into the surrounding formation. Finally, in step 6 the drillstring 107 is disconnected from the charge carrier string 105 and pulled out.

Figure 2:
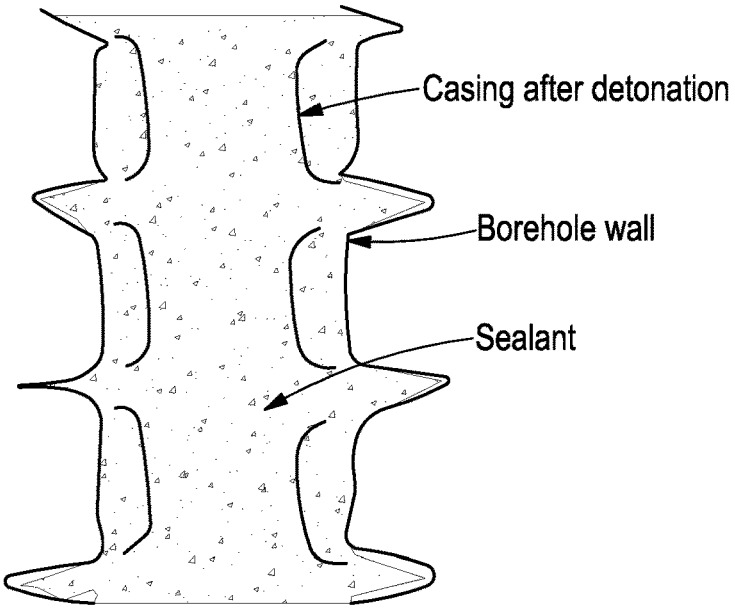
FIG. 2 shows in detail a section of a plug.

FIG. 2 illustrates a detail of the apparatus and procedure of step 6 of FIG. 1, showing the sealant filling the space between the casing and the borehole wall of the surrounding formation. Although the Figure shows the bent casing being located wholly within the sealant, the tips of the bent edges of the casing may penetrate into the formation, thus preventing the sections of casing from falling into the well.

Figure 3A:
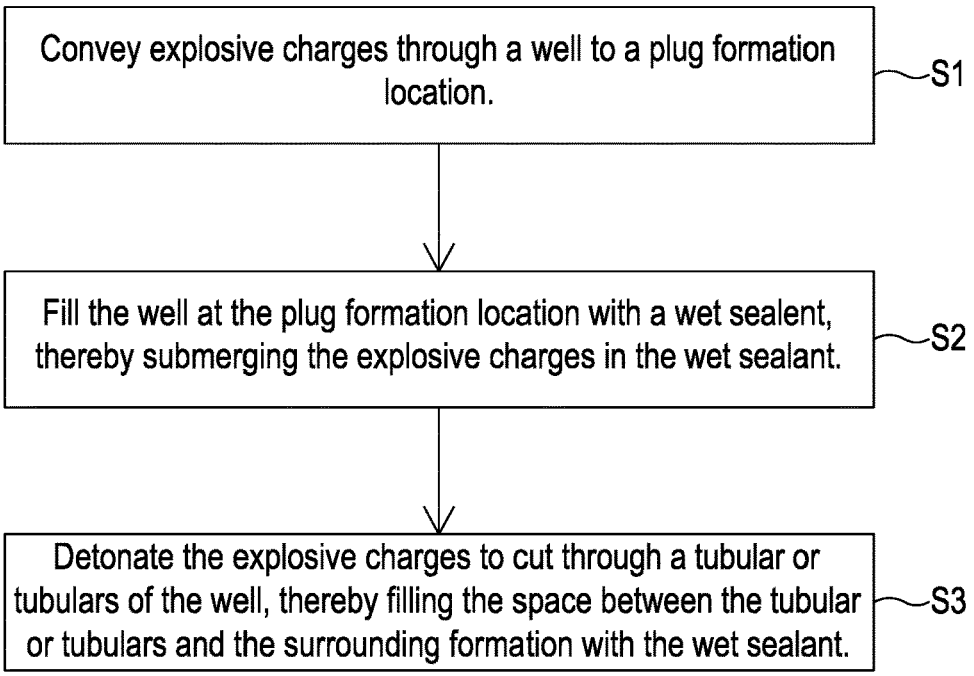
FIG. 3*a* is a flow diagram illustrating a method of plugging a well.

FIG. 3*a* is a flow chart relating to a method of plugging a well according to an embodiment of the invention. The method entails conveying explosive charges through the well to a plug formation location, S1. With the charges in place, filling the well at the plug formation location with a wet sealant, thereby submerging the explosive charges in the sealant, S2. The charges are then detonated to cut through a tubular or tubulars of the well, filling the space between the tubular or tubulars and the surrounding formation with the wet sealant, S3.

Figure 3B:
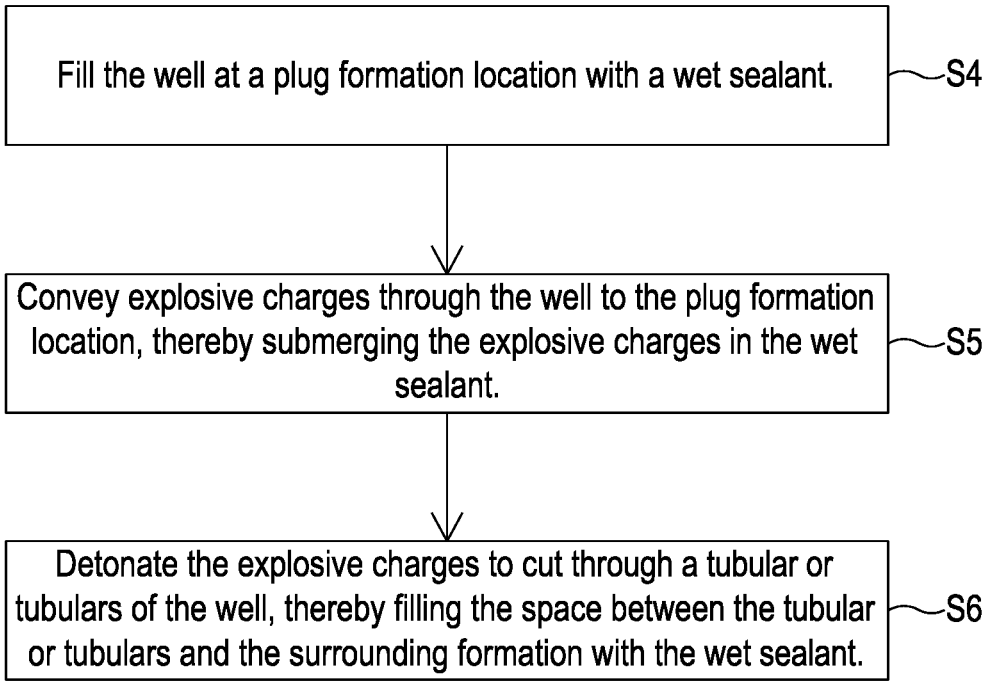
FIG. 3*b* is a flow diagram illustrating an alternative method of plugging a well.

An alternative method of plugging a well according to an embodiment of the invention is illustrated in the flow chart in FIG. 3*b*. The method entails filling the well at a plug formation location with a wet sealant, S4. With the sealant in place, explosive charges are conveyed through the well to the plug formation location, thereby submerging the explosive charges in the wet sealant, S5. The charges are then detonated to cut through a tubular or tubulars of the well, filling the space between the tubular or tubulars and the surrounding formation with the wet sealant, S6. The final steps in the flow charts of FIGS. 3*a* and 3*b* (S3 and S6) are the same.

Figure 4:
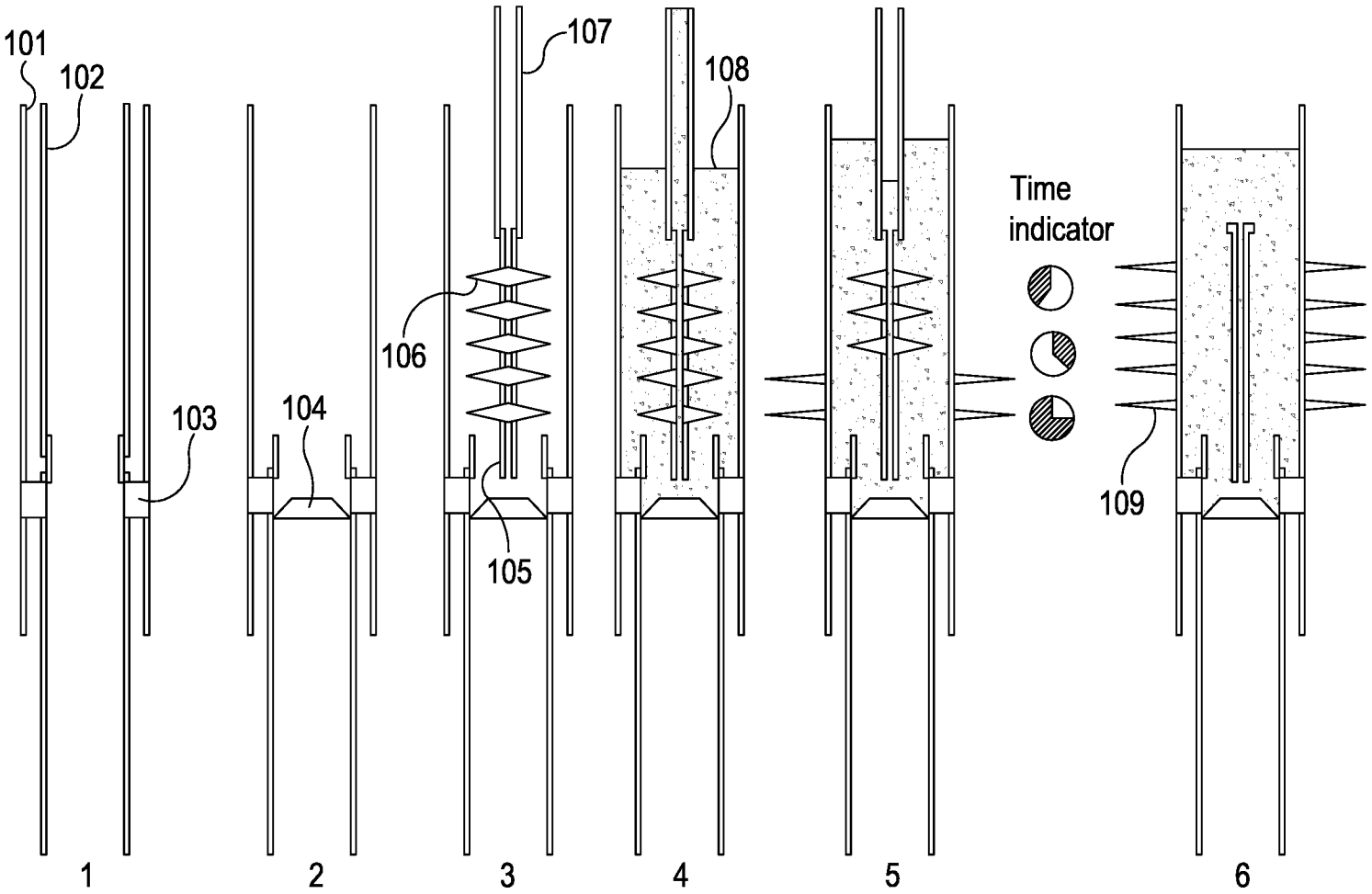
FIG. 4 illustrates a procedure for forming a plug in a well, in accordance with a second embodiment of the invention.

FIG. 4 shows sequential steps 1 to 6 of a second embodiment of the invention. Steps 1 to 4 and 6 are the same as in the first embodiment illustrated in FIG. 1. In step 5, which occurs after the explosive charges 106 have been submerged by the wet sealant 108, the charges 106 are detonated sequentially, starting with the lowermost charge. Sequential steps will enhance the flow of sealant out against formation and in annulus.

Figure 5:
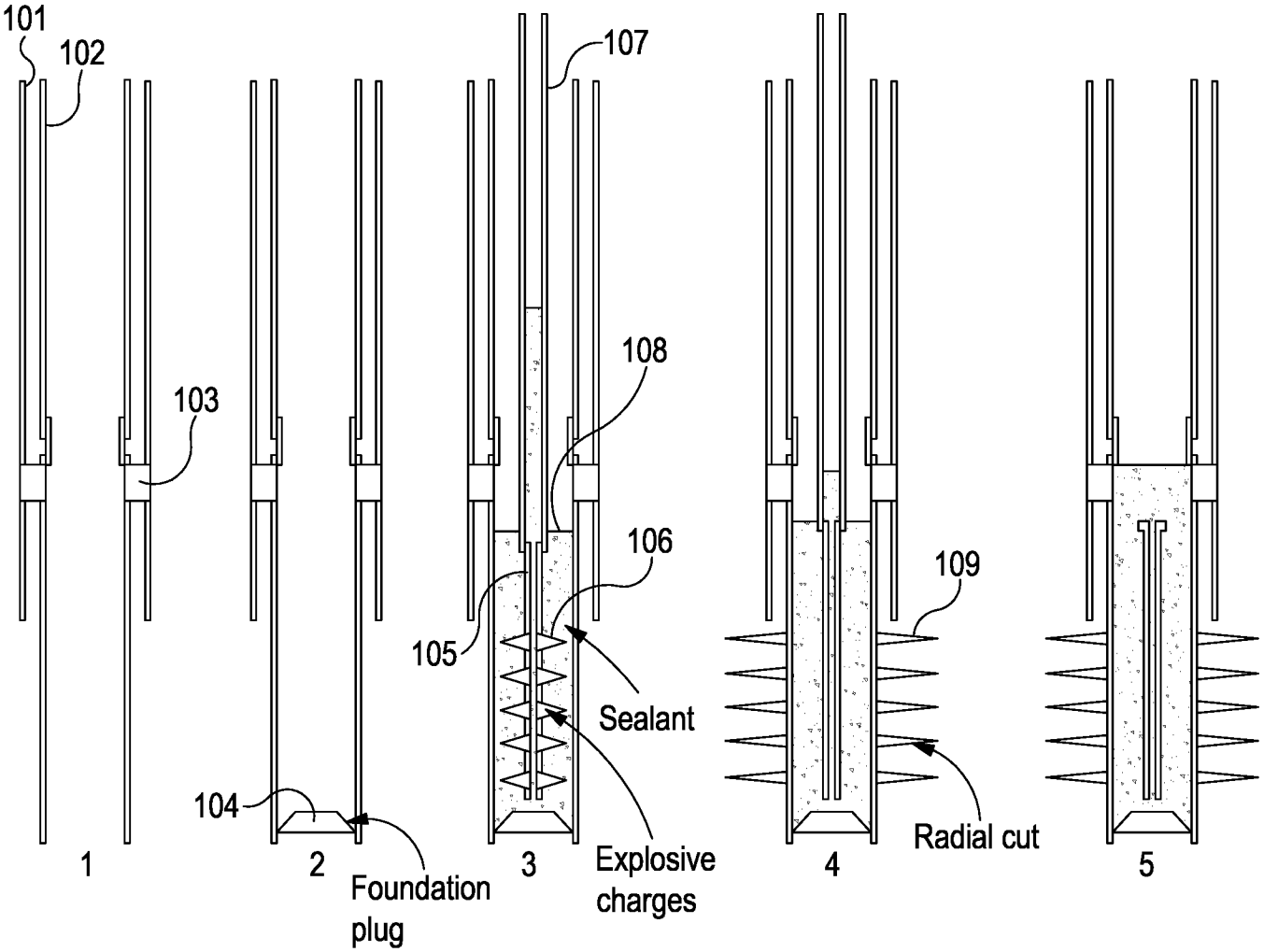
FIG. 5 illustrates a procedure for forming a plug in a well below the well casing, in accordance with a third embodiment of the invention.

FIG. 5 shows sequential steps 1 to 5 of a third embodiment of the invention. The foundation plug 104 is set at a sufficient distance below the production packer 103 (normally inside 9⅝ in casing) in step 2. In step 3, the explosive charges 106 are lowered to depth using a drillstring 107, whereby the top of the charges is below the bottom end of the casing. The plug area is filled with a sealant 108, so that the charges 106 are submerged by the sealant 108. The charges 106 are detonated, preferably sequentially as illustrated in FIG. 4, to create radial cuts 109 through the tubing 102 and into the surrounding formation.

In another embodiment of the invention, the plug assembly, comprising at least the foundation plug 104, is set and the sealant 108 is provided at the plug formation location in the same step, prior to conveying the explosive charges 106. The explosive charges 106 are then placed in the wet sealant 108 and subsequently detonated whilst submerged within the wet sealant 108. It will be appreciated that the main benefit to the plug quality arises from detonating the charges whilst they are submerged by the wet sealant, regardless of the process sequence.

It will be appreciated by the person of skill in the art that various modifications may be made to the above described embodiments without departing from the scope of the invention. For example, the sealant can be circulated down through the drillstring and centric pipe through or outside the charges, or be carried down as a part of the string and put in place at the location. The stinger could be the centre pipe carrying the charges, in which case the system can be set up as a one-trip solution.

Figure 6:
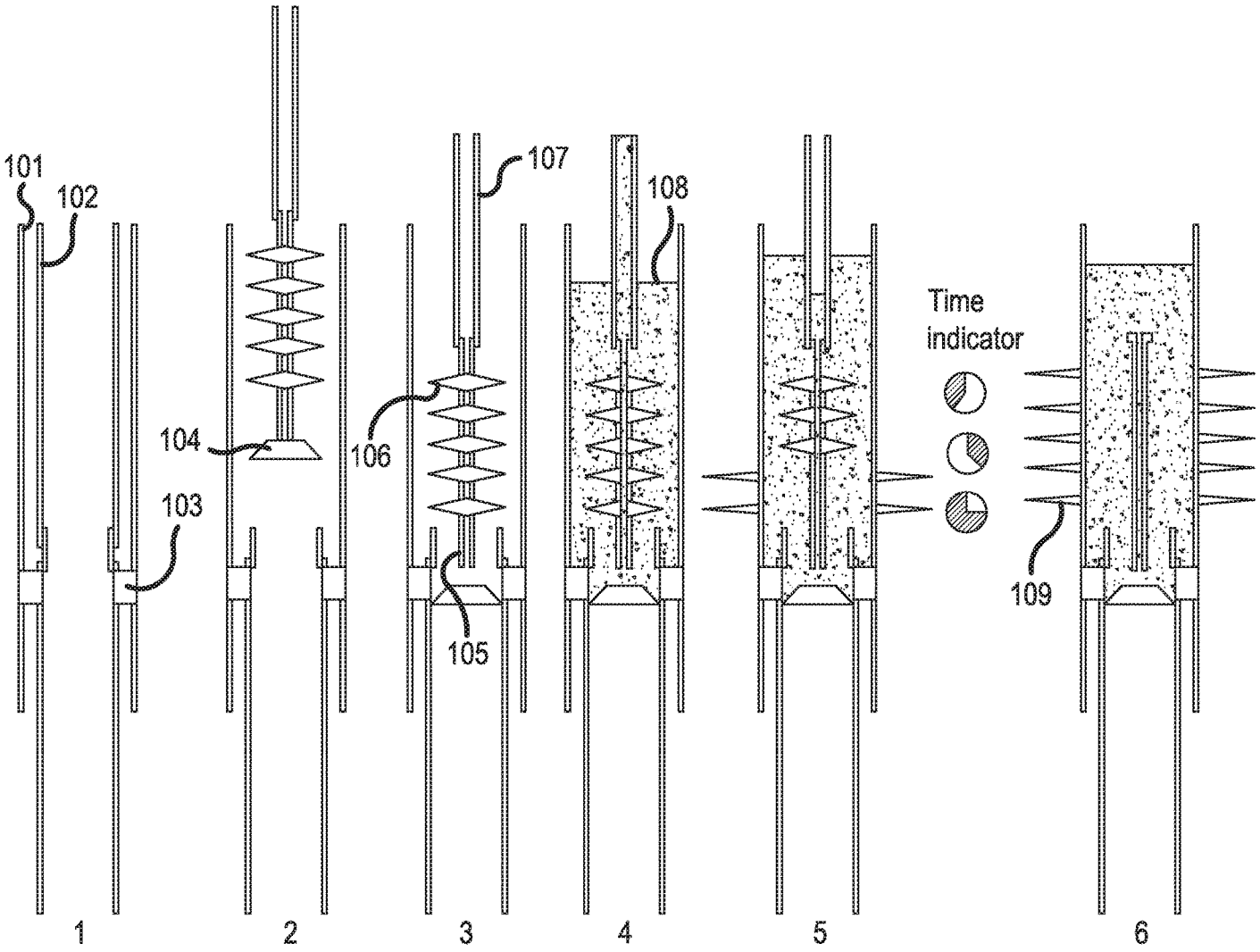
FIG. 6 illustrates a procedure for conveying the plug and explosive charges in one trip, in accordance with a fourth embodiment of the invention.

The foundation plug 104 may be set and the explosive charges 106 placed in the plug area in one step, by conveying the foundation plug 104 at the end of the charge carrier string 105. The charge carrier string 105 conveying the foundation plug 104 so that foundation plug 104 is set and the explosive charges 106 placed in the plug area in one step is depicted in FIG. 6.

As an alternative to the use of directional explosive charges, the explosive charges 106 may be part of one or more perforation guns used to cut through the tubular or tubulars and into the surrounding formation.

The invention claimed is:

1. A method of plugging a well extending into a formation to facilitate temporary or permanent abandonment of the well, the method comprising:

conveying, in one trip, a plug assembly and one or more explosive charges through the well together with a structure for providing a wet sealant, the structure comprising a stinger, wherein the plug assembly comprises a foundation plug conveyed at an end of the stinger and wherein the one or more explosive charges are attached to the stinger;

setting the plug assembly beneath a plug formation location prior to providing the wet sealant, wherein the foundation plug is suitable for supporting the wet sealant;

extruding the wet sealant through the stinger to the plug formation location so that the wet sealant is supported by the foundation plug, so as to submerge the one or more explosive charges in the wet sealant; and detonating the one or more explosive charges in the wet sealant at the plug formation location to cut through a tubular or tubulars of the well and into the formation.

2. The method according to claim 1, further comprising providing additional sealant to the plug formation location after detonating the one or more explosive charges.

3. The method according to claim 1, further comprising pressurizing the well above the plug formation location after detonating the one or more explosive charges whilst the sealant remains wet.

4. The method according to claim 1, wherein the plug formation location is below a production packer.

5. The method according to claim 1, wherein said tubular or tubulars include at least a casing and a surrounding cement layer between the casing and the formation.

6. The method according to claim 5, wherein said tubular or tubulars further include a production liner.

7. The method according to claim 1, further comprising detonating a plurality of explosive charges, the method comprising detonating these sequentially.

8. The method according to claim 7, wherein a lowermost charge is detonated first.

9. The method according to claim 1, wherein the plug formation location is above a production packer, and the well comprises tubing above the production packer.

10. The method according to claim 9, further comprising one of; pulling out the tubing above the production packer, and partially lifting the tubing above the production packer, prior to conveying the one or more explosive charges and providing the wet sealant.

11. The method according to claim 9, further comprising leaving the tubing in the well above the production packer, throughout the plugging operation.

* * * * *